United States Patent [19]

Falconer

[11] Patent Number: 4,868,564

[45] Date of Patent: Sep. 19, 1989

[54] REMOTE CONTROLLED DEADNESS BOARD FOR CROQUET

[76] Inventor: Harry W. Falconer, 270 Riverside Dr., Rossford, Ohio 43460

[21] Appl. No.: 176,836

[22] Filed: Apr. 4, 1988

[51] Int. Cl.[4] ..... H04Q 7/00; A63B 71/06

[52] U.S. Cl. ..... 340/825.690; 340/323 R; 273/56; 273/1 ES

[58] Field of Search ..... 340/825.69, 323; 273/56, 83; 364/411; 377/5; 235/90

[56] References Cited

U.S. PATENT DOCUMENTS

| | | | |
|---|---|---|---|
| 1,386,996 | 8/1921 | Edwards | 235/90 |
| 2,601,393 | 6/1952 | Hammond, Jr. | 340/825.69 |
| 3,651,507 | 3/1972 | Abbott | 340/323 |
| 4,119,838 | 10/1978 | Genuit | 340/323 R |

*Primary Examiner*—Donald J. Yusko
*Assistant Examiner*—Yuk H. Lau
*Attorney, Agent, or Firm*—Thomas M. Freiburger

[57] ABSTRACT

A deadness board apparatus remotely displays the "dead" status of each player in the game of croquet with respect to each other's player or color. The system includes a "dead" scoreboard with colored panels for ball colors and a light in each panel. The "on" or "off" status of the colored panels indicates "dead" or "alive" status of a player with respect to each of the three other colors. The lights are controlled by relays which are in turn controlled remotely by radio signals from transmitters which can be carried by each player. Each transmitter may additionally include a control button for increasing the player's (or team's ) score when his ball is hit through a wicket.

6 Claims, 5 Drawing Sheets

-UNITS-
-TENS-
+14VDC
UN REG
+5VDC
1C9
1C10
1C11
1C12
74LS90
74LS47
.1µfd
510Ω 1/2W
56Ω 5W
IN914
LED1
LED2
LED3
LED4
LED5
LED6
LED7
LED8
LED9
LED10
LED11
LED12
LED13
RY7
RY8
RY9
RY10
RY11
RY12
RY13
RY14
RY15
RY16
RY17
RY18
RY19
FROM FIG. 4A
1/2 74LS21
AND
MANUAL RESET
RESET @ 27
1/4 74LS32
OR
DIGIT BLANK

REMOTE CONTROLLED DEADNESS BOARD FOR CROQUET

BACKGROUND OF THE INVENTION

This invention relates to croquet game apparatus, and more particularly to a "deadness" board which can be controlled remotely by the players, for use in croquet.

In the game of croquet, when played correctly according to the rules, a player is said to become "dead" on a particular color when his ball strikes another player's ball of that color. It remains in this status until the player hits his ball through the next wicket. The status of being dead on one or more colors restricts the player in that he may not again strike the ball of that color, on penalty of ending his turn, until his ball has passed through the next wicket. At that point, he is no longer dead on any color. While a player is dead on a color, the player of that color may use the "dead" player's ball as a stepping stone to continue his turn, without fear of the "dead" player's doing the same to his ball.

It is therefore important in croquet that the status of all players' balls as being dead or alive with respect to each of the other three colors must be either remembered, kept by a scorekeeper type person, or displayed for constant reference of all the players.

For this purpose, a deadness board has conventionally been included adjacent to a field of serious croquet. The deadness board would typically include twelve flaps in the four colors of the game. Adjacent to a color marker for each player is a series of three flaps, in each of the other players' colors. Each flap is pivoted or hinged so that either the front side or the back side can be displayed, indicating dead or not dead for that ball color with respect to a particular player. In this way, status of each player with respect to each of the other players' ball colors can be kept and displayed.

However, such conventional manual deadboards are not particularly convenient, because either a player or a scorekeeper is required to adjust the status of the twelve deadness color indicators nearly every time a ball is struck or a ball is put through a wicket. This greatly slows down the game, often leads to inaccuracies and disputes, and otherwise detracts from the enjoyment of the game.

It is a principal object of the invention to improve on previous croquet deadness display apparatus by providing for remote control of the display of each player's dead or alive status for each other player's color, controllable by the players in the game. The system of the present invention greatly speeds up the game, results in fewer inaccuracies or disputes and greatly adds to the enjoyment of players and spectators.

SUMMARY OF THE INVENTION

In accordance with the present invention, a croquet remotely controlled deadness board apparatus includes a deadness board with electrified colored panels for showing the dead or not dead status of each of four players or teams with respect to all other colors. The system includes radio activated relay devices to light or dim each colored panel and thus the displayed status of each player with respect to the other three colors whenever each of the 12 lamps is energized or de-energized.

Also included in the apparatus of the invention are four separate remote control radio signal devices, each of which can be carried on the person of each player in the game. On each remote control device there may be four separate spring-loaded impulse switches: one for each of the other three players' colors (the four colors conventionally being blue, red, black and yellow), and a fourth button for adjusting a numerical score or wicket count which may be included on the deadness board for each player or team of two players. Depression of this fourth button preferably also has the effect of dimming (switching off) all of a player's deadness indicator panels on the board to the "not dead" position, since passage through a wicket (which raises his wicket count by one) removes all "deadness" of that player.

A radio signal receiving device at the deadboard is capable of receiving and processing 17 different signals, four from each player's transmitter and one from a separate clock-operating transmitter, to operate switching relays at the deadness board.

Accordingly, it is among the objects of the invention to provide a remotely controlled croquet deadness board apparatus wherein radio signals are generated by each of four separate remote control transmitter devices carried by the players, with each player having the ability to shift his own displayed "dead" status for each of the other three colors, when a ball strikes another ball. These and other objects, advantages, features and characteristics of the invention will be apparent from the following description of a preferred embodiment, as illustrated in the accompanying drawings.

DESCRIPTION OF THE DRAWINGS

FIGS. 4A and 4B are together referred to as FIG. 4.

DESCRIPTION OF PREFERRED EMBODIMENT

Figure 1:
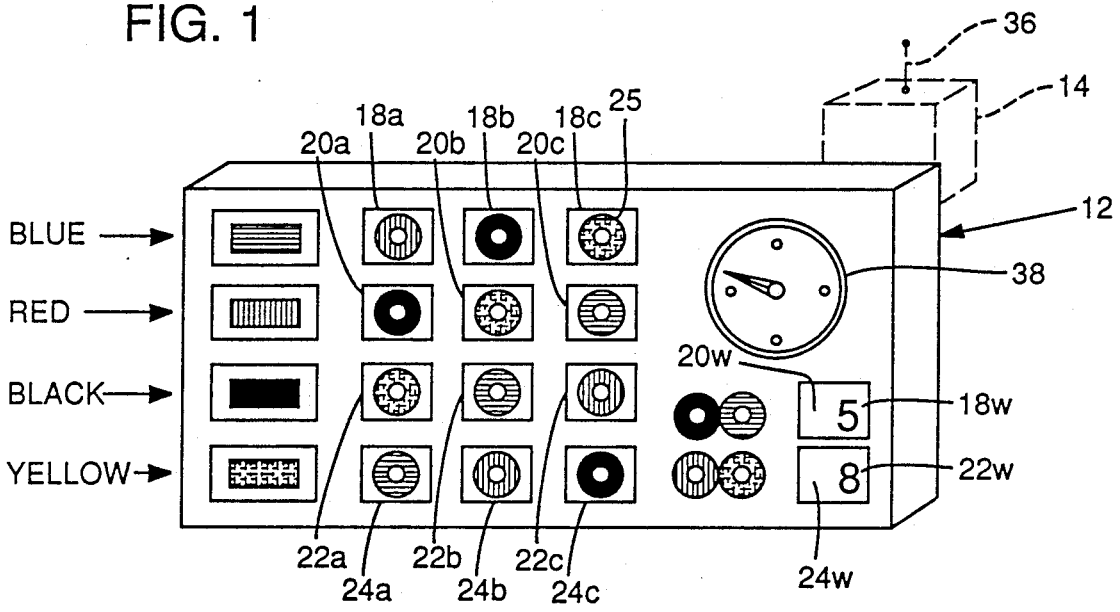
FIG. 1 is a perspective view illustrating a deadness board scoring device for croquet, with colored panels which indicate "dead" or "alive" status of each player with respect to each other player, by indicator lights in each colored panel. The device further includes a numerical score display or wicket count for each player or team, as well as a 60 second time clock.

In the drawing, FIG. 1 shows in perspective a part of the apparatus of the present invention for controlling the "dead" or "alive" displayed status of each player in the game of croquet. The apparatus of the invention includes a deadness board 12, with radio receiver apparatus generally indicated at 14, and a plurality of hand-held remote control devices 16*a*, 16*b*, 16*c* and 16*d* shown in FIG. 2 (generally referred to as 16), each of which is to be held by a different player in the game.

The deadness board's appearance and the manner of indicating "dead" status may take other forms if desired. The invention is directed primarily to the control of dead status display means for croquet, by convenient remote devices held by the players.

As illustrated in FIG. 1, the deadness board 12 preferably includes a series of twelve dead status display means 18*a, b, c*; 20 *a, b, c*; 22*a, b, c*; and 24*a, b, c*, each of which has two alternative faces, indicia or other alternative displays to indicate that a given player, identified at the left by color of the player, is dead or alive with respect to each other color or player. In the preferred embodiment the indicating device comprises bright lamps 25 which are either illuminated to indicate deadness on a color, or not illuminated, to indicate alive status on that color.

Figure 2:
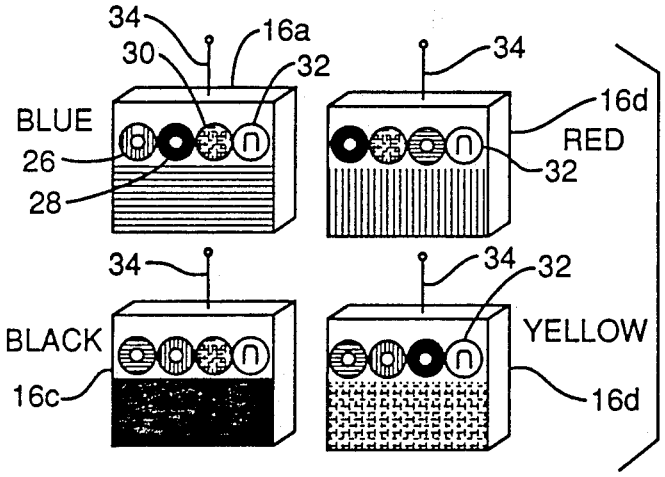
FIG. 2 is a view showing a typical one of four remote control transmitter devices to be carried by the players, each with buttons for controlling three colored illuminated panels in the other three players' colors and with a fourth button for controlling the player's (or teams's) wicket count score and extinguising or dimming all of the player's "dead" panels when he hits his ball through a wicket.

As shown in FIG. 2, each hand-held remote control device includes four buttons 26, 28, 30 and 32, the first three of which are color-coordinated with the colors of the other three players, i.e. the three players other than the player who will hold the illustrated hand-held remote control device 16. The remote control unit 16 is itself preferably colored with a face color to indicate the player who will carry it (e.g., the unit 16*a* is colored blue). Pressing of the blue player's red button 26, for example, will illuminate the deadness panel 18*a* shown in FIG. 1. The fourth button 32 serves to increase the player's "score" or wicket count on a numerical scoring display 18*w*, 20*w*, 22*w* or 24*w*, at the right side of the deadboard 12. These numerical displays may comprise seven-line numerical formats as indicated (with LED's or LCD's or other activation) or they can be illuminated dot matrices or mechanical number wheels, in any conventional display format. Each push of the button 32 operates a stepping switch at the deadboard for that particular wicket number display 18*w*, 20*w*, raising the wicket count number incrementally by one, in the range of 0–26. There are 12 wicket points in a tournament croquet game, plus one stake point. The upper score display 18w shows the total of blue's score and black's score; the lower display 22*w* shows the total of red's score and yellow's score. Since two players or balls play as a team, the first to reach 26 points wins the game. If the score shows 26 points and the scoring button 32 is then again pushed, the display returns to "0". (The balls are always paired this way in proper croquet games. If there are four players, blue and black are teammates against red and yellow. If two players, one player plays both the blue and black balls, the other the red and yellow balls. The first to reach 26 points wins, in six-wicket croquet.)

At the same time, each push of the button 32 will cancel all dead status 18*a*, 18*b*, etc. in that player's horizontal row, returning all to the "alive" position or condition. If lighted panels such as illustrated in the drawings are used, with lamps 25, all lamps will be turned off.

Figure 4A:
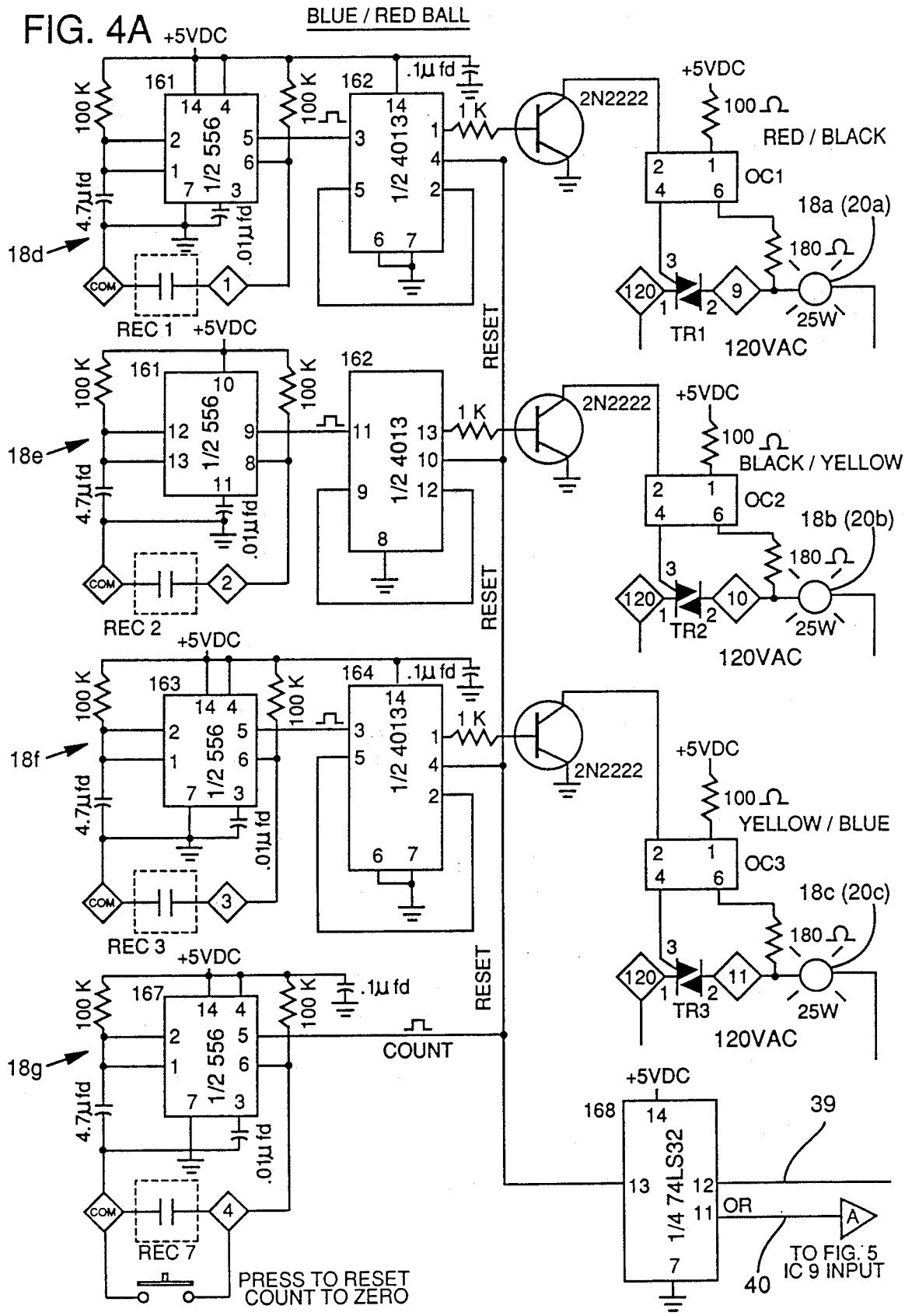
FIGS. 4A and 4B are two parts of a schematic circuit diagram showing a portion of a circuit which may be included in the system of the invention, in a preferred embodiment.

As shown in FIG. 2, each hand-held remote control device 16 includes an antenna 34, each device 16 being a transmitter of four different signals. The radio receiver device 14 on the deadness board has a receiving antenna 36. Electrical circuitry associated with the remote control units 16 as with the deadness board 12 is outlined in FIGS. 4 and 5, described below.

Figure 3:
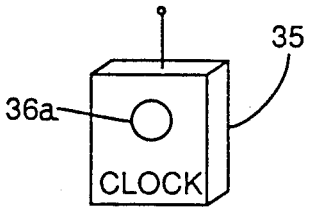
FIG. 3 is a view showing a fifth remote control transmitter device for controlling a timer clock preferably included on the deadness board.

FIG. 3 indicates another hand-held remote control unit 35 with a push button 36*a*. This unit is for controlling a time clock 38 on the deadness board. The time clock is activated (by a push of the button 36*a*) when a player's turn begins, and allows the player 60 seconds to complete his turn or to hit his ball. When the clock completes a 60-second revolution a buzzer sounds, and if the playr has not hit his ball his turn is forfeited. If the ball is hit before the one-minute deadline, the holder of the remote unit 35 again presses the button 36*a*, and the clock stops and automatically resets, for the next player or for a succeeding shot of the same player.

Figure 4B:
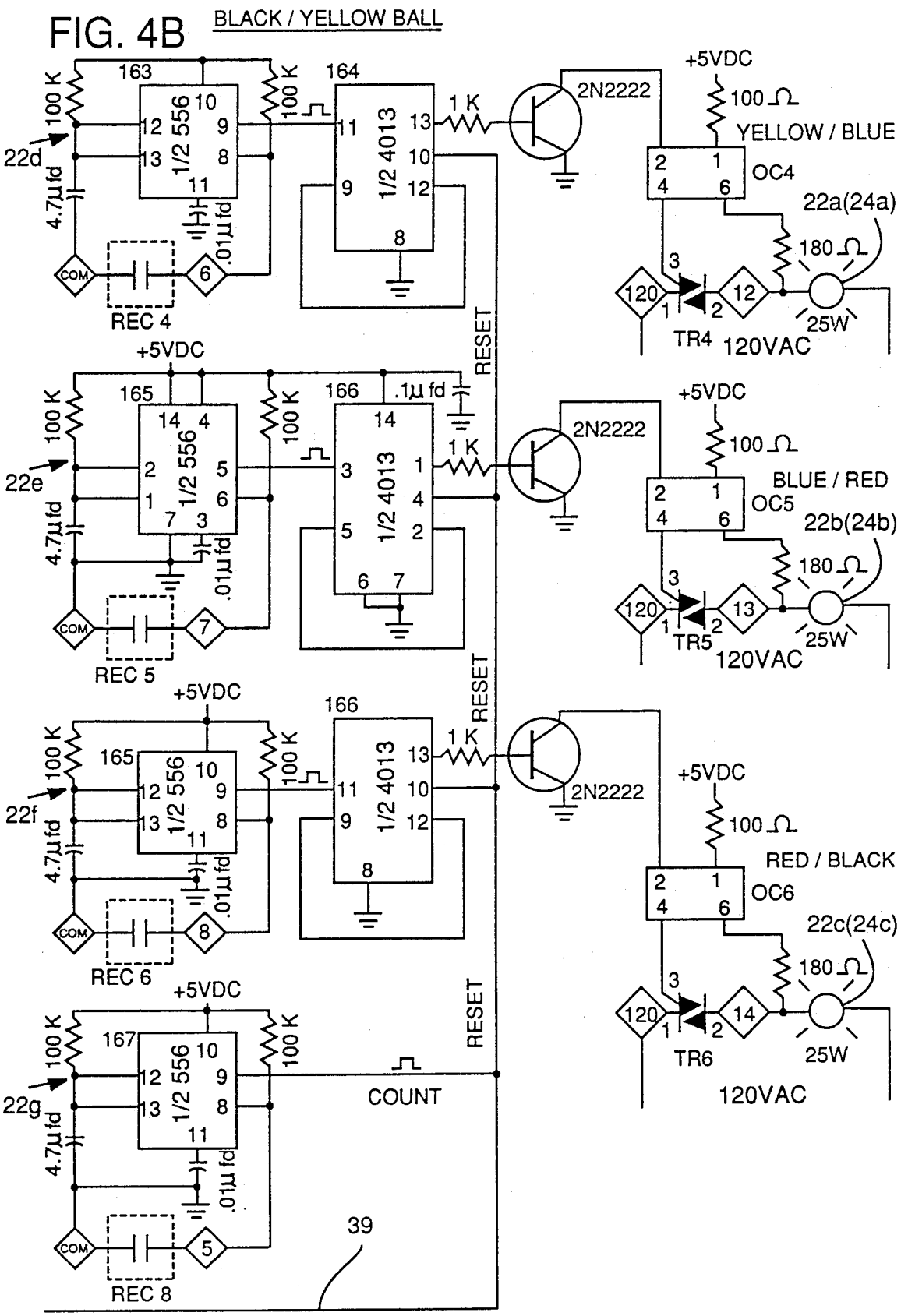
Figure 5:
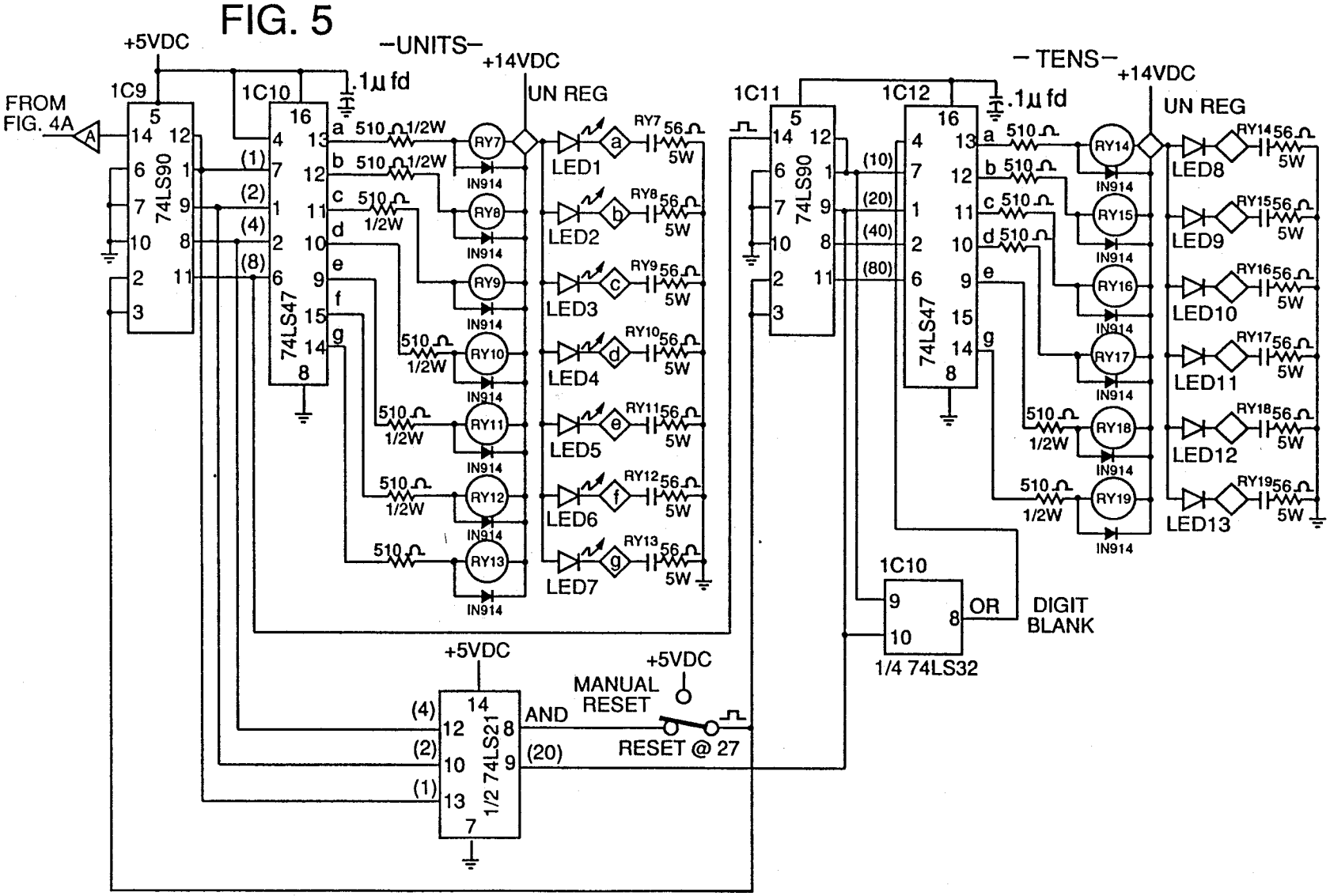
FIG. 5 is another portion of a circuit diagram.

FIGS. 4 and 5 are schematics indicating one example of circuitry which may be employed to carry out the functions of the deadness indication, scoring and timing functions of the invention.

FIG. 4 (4A and 4B taken together, connected by a line 39 at the bottom of each position of the schematic) shows one part of the circuit, connected by a line 40 at the bottom of the schematic to the circuit shown in FIG. 5, as indicated by the letter A in a triangle, on both figures.

The schematic of FIG. 4 represents one of two identical printed circuit boards, one for the blue and black balls or players, and another for the red and yellow balls or players. Thus, the diagram of FIG. 4 is labeled on the left side (4A), BLUE/RED BALL (blue or red), and on the right side (4B), BLACK/YELLOW BALL (black or yellow). Blue and black are paired as a team as are red and yellow, as discussed above.

Each printed circuit such as shown in FIG. 4 operates six of the twelve deadness-indicating lamps 25 on the deadness board, i.e. the twelve lamps on the deadness indicator panels 18*a, b, c*, 20*a, b, c*, etc. The six lamps shown on FIG. 4 are identified by panel numbers. The first panel number given, such as 18*a* at the upper left lamp in the schematic, is for the blue player, the lamp indicating deadness status on the red ball. The parenthetical panel number (20*a*) is for the red player (the identical, other circuit board), indicating deadness status on the black ball, as noted on the drawing.

Each light is controlled by a subcircuit 18*d*, 18*e*, 18*f*, 22*d*, 22*e*, 22*f* as shown in FIG. 4, each of which has a receiver (REC 1, REC 2, REC 3, etc.) which may be similar to a standard garage-door opener receiver. In each subcircuit is a timer which in this embodiment comprises one-half of a 556 timer (the other half is in the adjacent subcircuit, as in the subcircuits 18*d* and 18*e*).

With reference to the upper left lamp control subcircuit 18*d* shown in FIG. 4, the 556 timer produces a short time delay (approximately ½ second). The REC 1 is closed whenever the blue player pushes his button 26 (FIG. 2) indicating deadness on red. The ½ second pulse is created and is fed into the 4013 D flip-flop shown (one-half the 4013 is used, the other half being used in the adjacent subcircuit.

The 4013 D flip-flop is wired as a toggle. The input on pin 13 controls the toggle. When it goes on one time it turns the output to the lamp on, and the next time it turns the output off. The output is turned on when REC 1 is closed one time, and turned off when REC 1 is closed a second time. This allows the player to reverse a mistaken button push--the output to the lamp is also turned off when the player increases his wicket count, as discussed above and further explained below.

The output of the 4013 (at pin 1) controls a standard switching resistor 2N2222, which in turn controls an optocoupler OC1. The OC1 is a small LED that controls a triac which allows current to flow through the light bulb, as indicated in FIG. 4.

The two subcircuits 18*f* and 22*d* for the blue player's deadness on the yellow ball and the black player's deadness on the yellow ball (or red's deadness on the blue and yellow's deadness on blue) share the integrated circuits IC3 and IC4, i.e. the 556 and the 4013 illustrated. IC5 and IC6 in this embodiment are shared by subcircuits 22*e* and 22*f*, as illustrated.

The lower left subcircuit 18*g* in FIG. 4 responds to the wicket count button 32 on the blue player's remote unite 16*a* (or, for the identical other circuit, on the red player's button 32). A press of this button will cancel all deadness indication for the player (e.g. the blue player), and will increase the team's wicket count score by one. This is because when a player hits his ball through a wicket he is no longer dead on any color.

Thus, when REC 7 is closed by blue's pushing the wicket button 32, a ½ second pulse is generated for the count, as well serving as a reset pulse to reset all deadness lamps for the player to off. All 4013 flip-flops for the blue player, as indicated, are reset.

The same pulse goes down to IC8, a 74LS32 shown below, one-fourth of a quad or gate which controls (via pin 11) the wicket count based on blue's wicket count button or black's (blue's partner) wicket count button. As indicated, this count pulse goes to the circuitry of FIG. 5, to the IC9 input, via the line 40.

As shown in FIG. 5, the count pulse goes to pin 14 of IC9, a 74LS90, which is a decade counter. Each trailing edge of a pulse on pin 14 of the 74LS90 updates the output on a BCD (binary coded decimal) code, increasing by one, up to a count of nine.

Figure 6:
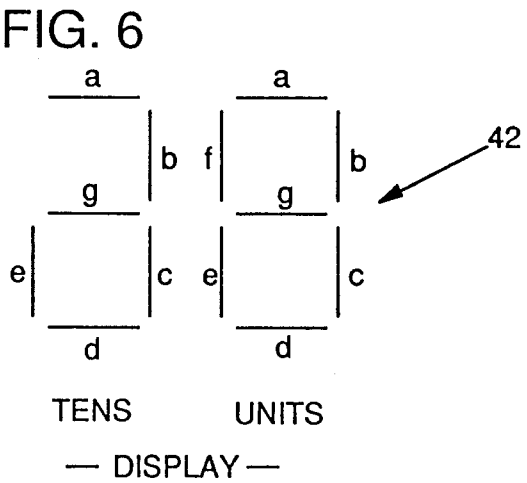
FIG. 6 is a schematic drawing showing a numerical display of the deadness board.

The output of the BCD driver feeds a seven-segment display driver (for units display), the 74LS47, which in turn controls a numerical seven-segment display 42 shown in FIG. 6. The seven segments a through g are controlled by relays RY7–RY13 as in FIG. 5. Diodes 1L914 around R47–R413 eliminate any noise produced by de-energization of the relays. The controlled segments a through g are indicated at the outputs of the 74LS47.

Pin 11 of the 74LS90, the "8" column, connects to pin 14 of the 74LS90 on the tens control side of FIG. 5. The right side, or tens side of FIG. 5 works similarly to units, except that every time a signal at the "8" (pin 11) of the units 74LS90 goes off, the pin 14 on the tens side 74LS90 is updated. This represents occurrences of units going to zero, at which time the tens side should be increased by one.

As shown in FIG. 6, the tens segmented display only has six segments, the "f" segment being unnecessary because the score never goes beyond 26 and "0" is never displayed on this left digit.

Below the units side in FIG. 5 is shown a 74LS21, which is an AND gate, requiring a signal at all pins 10, 12, 13 and 9 to produce an output. These pins represent the numbers 4, 2, 1 and 20 as indicated, adding up to 27. A count of 27, one unit higher than a winning score of 26, resets the score to zero. This occurs when an additional wicket count pulse occurs, intentionally entered to reset. A reset button 43 may also be included on the deadness board (shown only in FIG. 4A), for resetting the scores to zero from that location.

Reset occurs for both scores on the score displays 18*w* and 22*w* (FIG. 1) when the score goes one beyond 26.

Another part of the OR gate IC8, the 74LS32 (FIG. 4), is shown in FIG. 5 with pins 8, 9 and 10. This part of the OR gate will blank the left digit (the tens digit) whenever the score is less than 10. It is preferred that this display be off rather than reading "0". As indicated in FIG. 5, if there is no input at either pin 9 or pin 10 of the IC8 portion in FIG. 5, there will be no input at pin 4 of the 74LS90 directly above, and the tens digit will be off or blanked.

Figure 7:
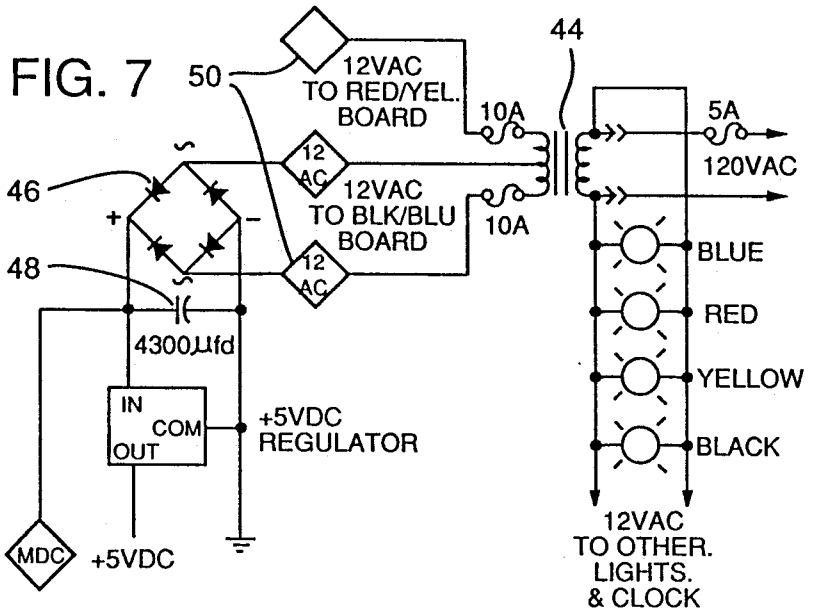
FIG. 7 is a schematic drawing showing a power supply for the system of the invention.

FIG. 7 shows a main power control circuit for the system of the invention. The 120 volts coming in at the right may turn on four light bulbs which are always on when a game is in progress. They may be associated with the four color blocks at the left on the deadness board shown in FIG. 1, but these lamps are not specifically shown.

A step-down transformer 44 steps the power down to 24 volts, center-tapped, giving two 12-volt circuits. One is used for one of the teams, e.g. blue/black shown as the lower circuit and served by one of the identical circuit boards just described (FIGS. 4 and 5). The other 12-volt circuit is indicated as for the red/yellow team and circuit board, but is not shown in detail.

The 12-volt power goes through a four-way bridge rectifier 46 and is filtered through a moderately large capacitor 48, because of the large current draw on the LED segments used on the score display. The output is an unregulated 14 volts, used to drive the displays. Five volts DC are also produced, regulated as indicated, for the main electronic circuitry.

A 24-volt output indicated at 50 is used to drive all of the 17 garage-door type receivers (REC 1 to REC 8 shown in FIG. 4, repeated with the identical circuit board not shown, as well as the clock control receiver response to the clock button 36 in FIG. 3).

Figure 8:
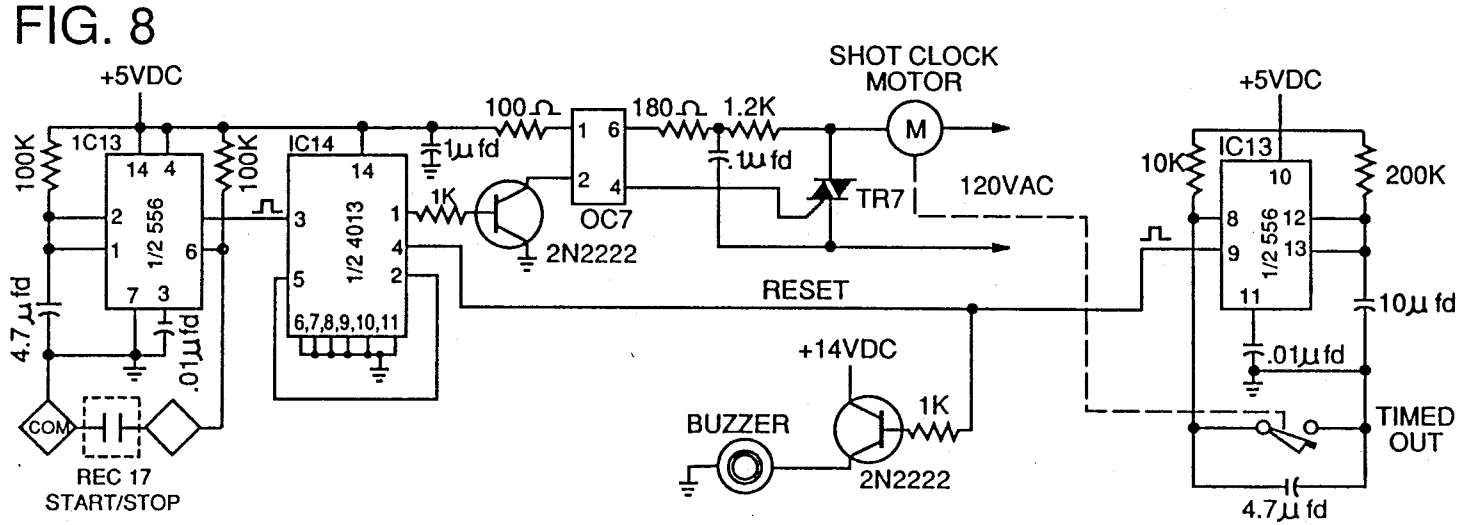
FIG. 8 is a schematic drawing indicating circuitry for a clock on the deadness board.

Circuitry for the shot clock 38 is shown in the schematic of FIG. 8. This circuit is similar to the circuitry for controlling the light bulbs. Another 556 timer controls a 4013 D flip-flop through a transistor and optocoupler OC7 that turns on and off a triac, as in the lamp control. Instead of turning a lamp on and off, the output turns the clock motor output on and off. At the end of a completed clock time (which may be 60 seconds), the circuit closes a contact which produces another pulse out of another 556 timer as indicated. That pulse automatically resets the dual flip-flop that turned the motor on, thus turning the motor off again, and allowing the clock to automatically reset to "0" position with a spring. The same pulse sets off a buzzer indicated that the player's turn is over, if the player has not struck his ball by that time.

The preferred embodiment described herein is intended to illustrate the principles of the invention, but not to be limiting of the scope of the invention. Various other embodiments and variations to this embodiment will be apparent to those skilled in the art and may be made without departing from the scope of the invention as defined in the following claims.

I claim:

1. A remote controlled deadness board apparatus for croquet, for enabling each player in the game to adjust the displayed status of the player with respect to each of the other three players' balls, comprising:

a deadness board having four separate status display means, one for each playr, for indicating the status of each player, by color, as dead or alive with rspect to each of the other three colors, a series of four separate hand-held remote control devices carriable by and operable by the players, each having three color-coordinated switch buttons for controlling deadness board-displayed status of a player with respect to each of the other three players, electrical circuit means at the deadness board for adjusting the displayed deadness status of the status display means for each player, radio signal control means associated with each hand-held remote control device and with the deadness board and the electrical circuit means, for adjusting the displayed deadness status of each color of a status display means on the deadness board whenever a switch button of a color corresponding to a color of that status display means is pushed on a hand-held remote control device associated with that status display means.

2. The apparatus according to claim 1, wherein each hand-held remote control device includes a fourth button, with the radio signal control means of the deadness board and the hand-held device including associated control means for shifting the deadness board-displayed status of the player associated with that hand-held remote control device to alive status with respect to all of the other three colors when the fourth button is pushed.

3. The apparatus according to claim 2, wherein the deadness board includes a wicket count score display, and wherein said associated means includes means for increasing the wicket count score display for a player when the fourth button of that player is pushed.

4. The apparatus according to claim 1, wherein the radio signal control means includes associated means for shifting the position of a status display means in one direction with one push of an associated button switch on a hand-held remote control device, and for shifting the position of the dead status display means in the opposite direction with a succeeding push of the same button.

5. A remotely controlled deadness board for croquet, for displaying the dead or alive status of each player with respect to each of the other players' colors, comprising, a display board with the colors blue, black, red and yellow in a series of player color blocks aligned with deadness display areas for each of the blue, black, red and yellow players, in each deadness display area on the deadness board, a series of three color indications in the colors of the three players other than the player whose deadness status is being indicated in that display area, at each color indication in each player's deadness display area, a lamp bright enough to be easily seen in daylight, and lamp switching means associated with the deadness board for selectively switching each lamp on or off, a series of hand held remote control devices, one for each croquet player, each being designated for a particular player by color and each having a series of three control buttons identified by the colors of the other three players, each being for the control of the displayed deadness status indicator lamp for the color of one of the other players, radio transmitter means associated with each of the hand held remote control devices, for sending a particular signal when each button is pushed, the signal being dedicated to control of one of the twelve lamps on the deadness board, and radio receiver means associated with the deadness board and connected to said lamp switching means, for receiving the particular signals from the remote control means and for sending an appropriate control signal to the lamp switching means for control of the particular lamp to which the transmitted signal is dedicated.

6. The deadness board apparatus of claim 5, wherein each hand held remote control device further includes a wicket count button for transmitting a signal for control of a wicket count score displayed on the deadness board, and wherein the radio receiver means associated with the deadness board includes means for switching off all deadness indicator lamps in a player's deadness display area when the wicket count button for that player is pushed.

* * * * *